US005577644A

United States Patent [19]

Chen

[11] Patent Number: 5,577,644

[45] Date of Patent: Nov. 26, 1996

[54] TOY DOLL AND HANGER ASSEMBLY

[76] Inventor: Chao-Yang Chen, 8F-3, No. 321, Fu Hsing S. Road, Sec. 1, Taipei, Taiwan

[21] Appl. No.: 600,190

[22] Filed: Feb. 12, 1996

[51] Int. Cl.[6] ..... A47G 25/14; A47G 25/28

[52] U.S. Cl. ..... 223/85; 223/DIG. 4

[58] Field of Search ..... 223/85, 88, 92, 223/95, DIG. 4; 446/73, 330

[56] References Cited

U.S. PATENT DOCUMENTS

| | | | |
|---|---|---|---|
| D. 123,389 | 11/1940 | Dunlap . | |
| 5,201,443 | 4/1993 | Oswald . | |
| 5,417,352 | 5/1995 | Jen | 223/85 |
| 5,503,311 | 4/1996 | Chen | 223/85 |

*Primary Examiner*—Bibhu Mohanty
*Attorney, Agent, or Firm*—Bacon & Thomas

[57] ABSTRACT

A toy doll and hanger assembly which includes a rod member having a first end, a second end, a first outward flange raised around the first end, and a second outward flange raised around the second end; a toy doll covered on the rod member, having a skin, a first hole and a second hole through the skin corresponding to the first end and second end of the rod member; a first cap fastened to the first end of the rod member and the first hole of the toy doll to hold down the periphery of the first hole of the toy doll, permitting the periphery of the first hole of the toy doll to be retained between the first cap and the first outward flange of the rod member; a second cap fastened to the second end of the rod member and the second hole of the toy doll to hold down the periphery of the second hole of the toy doll, permitting the periphery of the second hole of the toy doll to be retained between the second cap and the second outward flange of the rod member; and hanger means detachably connected to the second cap.

13 Claims, 8 Drawing Sheets

TOY DOLL AND HANGER ASSEMBLY

BACKGROUND OF THE INVENTION

The present invention relates to clothes hangers, and relates more particularly to a toy doll and hanger assembly covered with a toy doll.

Various clothes hanging devices have been disclosed, and have appeared on the market. Exemplars are seen in U.S. utility model 123,389 entitled "Clothes Hanger"; U.S. Pat. No. 5,002,886 entitled "Toy Doll and Accessories Therefor"; U.S. Pat. No. 5,167,564 entitled "Rotatable Hanger Assembly". Conventionally, a toy hanger is generally comprised of a toy doll, a loop fastened to the toy doll at the top for hanging, and a hanging ring or frame fastened to the toy doll at the bottom for holding clothes, towels, etc. The toy doll has the shape of an animal, cartoon figure, etc., and is stuffed with cotton, sponge, cloth strips, or bulky fibers. This structure of toy hanger is not suitable for mass production. Furthermore, the toy doll will be stretched by the load, therefore it deforms quickly with use.

There are also known toy hangers having a toy doll covered on the clothes hanger. However, when a clothes hanger is covered with a toy doll for decoration, the periphery of the hole through which the swivel hook of the hanger extends to the outside tends to be ruptured, causing the stuffing (sponge, cotton, cloth strips, etc.) to project out of the covering of the toy doll and to further hinder the rotation of the swivel hook.

SUMMARY OF THE INVENTION

The present invention has been accomplished to provide a toy doll and hanger assembly which eliminates the aforesaid problem. According to one aspect of the present invention, the toy doll and hanger assembly comprises a rod member having a first end, a second end, a first outward flange raised around the first end, and a second outward flange raised around the second end; a toy doll covered on the rod member, having a skin, a first hole and a second hole through the skin corresponding to the first end and second end of the rod member; a first cap fastened to the first end of the rod member and the first hole of the toy doll to hold down the periphery of the first hole of the toy doll, permitting the periphery of the first hole of the toy doll to be retained between the first cap and the first outward flange of the rod member; a second cap fastened to the second end of the rod member and the second hole of the toy doll to hold down the periphery of the second hole of the toy doll, permitting the periphery of the second hole of the toy doll to be retained between the second cap and the second outward flange of the rod member; and hanger means detachably connected to the second cap. According to another aspect of the present invention, the rod member can be a straight rod, curved rod, straight tube, or curved tube. According to still another aspect of the present invention, a double-sided adhesive tape may be used to fasten the first cap to the wall or the flat surface of a support. According to still another aspect of the present invention, the hanger means can be a hanger ring, a swivel hook, a suit hanger, a frame shaped like a plum blossom and having a plurality of clothes clips, a skirt hanger, a straight rod having a plurality of radial branches for hanging things, a curved hanger rod having a bottom end terminating in a transverse hanger rod for hanging things, or a double-hook hanger for hanging shoes.

DETAILED DESCRIPTION OF THE PREFERRED EMBODIMENT

Figure 1:
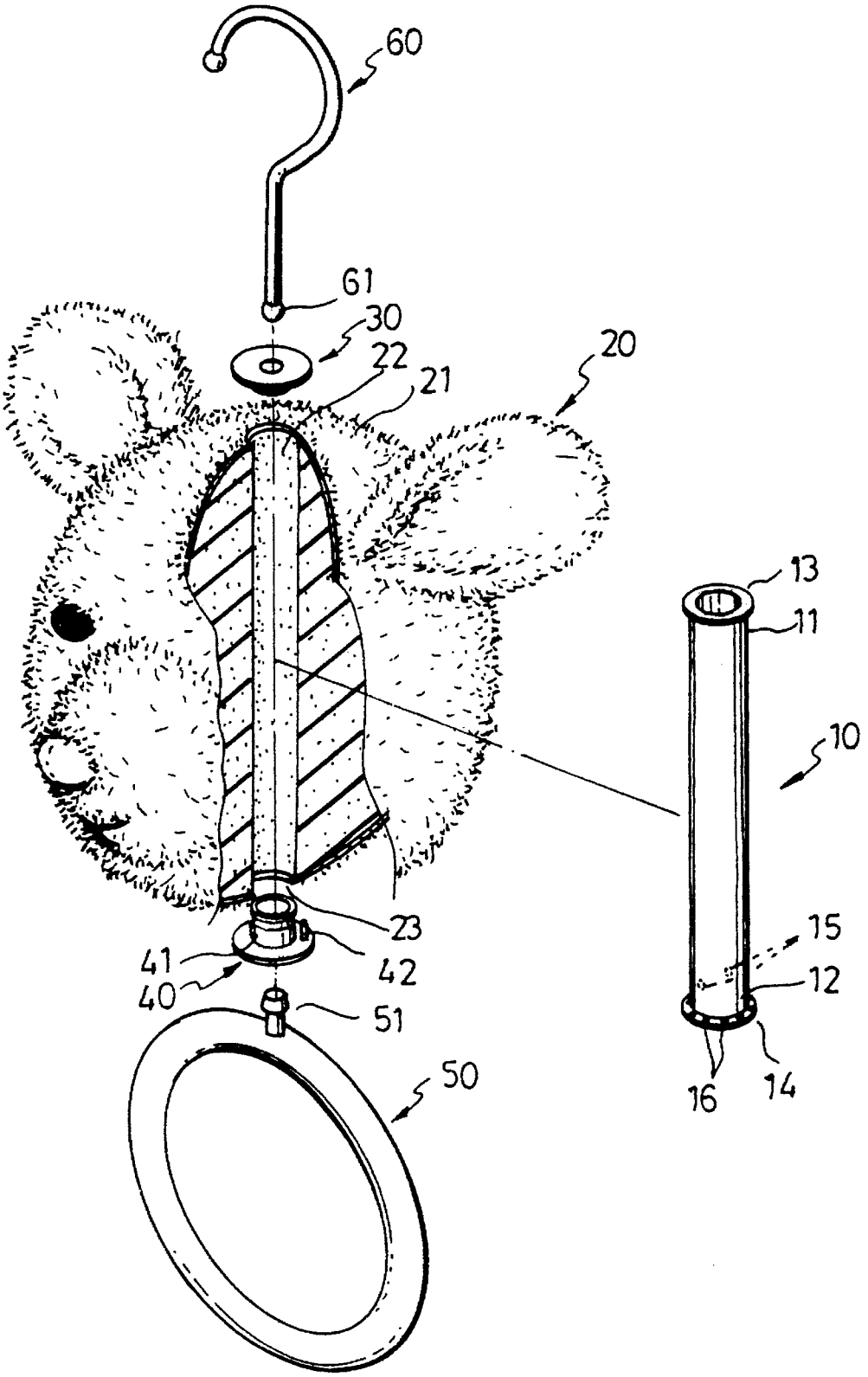
FIG. 1 is an exploded and partially cutaway view of a toy doll and hanger assembly according to a first embodiment of the present invention.
Figure 3:
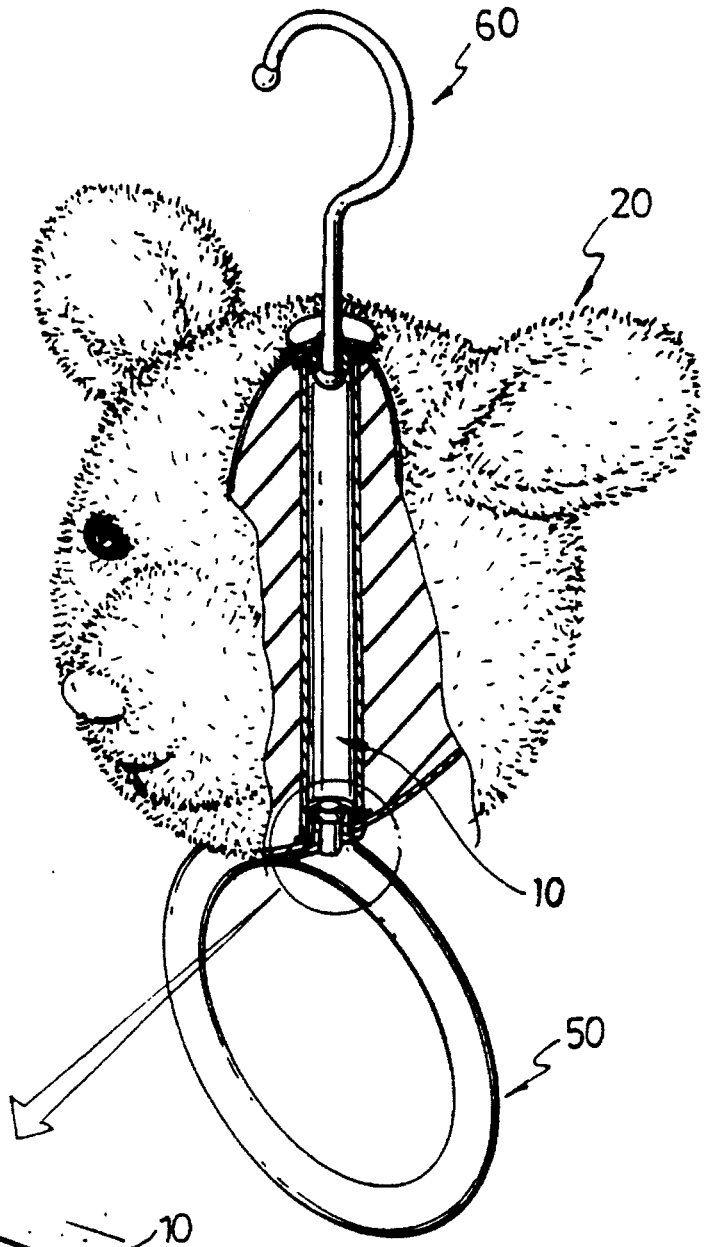
FIG. 3 is an assembly view of FIG. 1.
Figure 2:
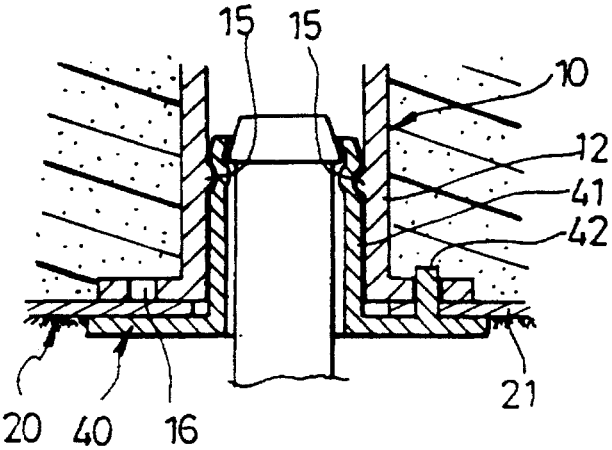
FIG. 2 is a partial view in section of the toy doll and hanger assembly shown in FIG. 1, showing the connecting rod of the clothes hanger fastened to the second cap at the second end of the rod member.

Referring to FIGS. 1, 2, and 3, a toy doll and hanger assembly in accordance with a first embodiment of the present invention is generally comprised of a rod member 10, a toy doll 20, a first cap 30, a second cap 40, a hanger 50, and a swivel hook 60. The rod member 10 can be a rigid sleeve having a first end 11, a second end 12, a first outward flange 13 raised around the first end 11, and a second outward flange 14 raised around the second end 12. The toy doll 20 is covered on the rod member 10, having a first hole 22 and a second hole 23 through the skin 21 corresponding to the first end 11 and second end 12 of the rod member 10. The first cap 30 and the second cap 40 are hollow, T-shaped caps respectively fastened to the first end 11 and second end 12 of the rod member 10. When the first cap 30 and the second cap 40 are respectively fastened to the first end 11 and second end 12 of the rod member 10, the periphery of the first hole 22 of the skin 21 of the toy doll 20 is firmly retained between the first cap 30 and the first outward flange 13 of the rod member 10, and the periphery of the second hole 23 is firmly retained between the second cap 40 and the second outward flange 14 of the rod member 10. The hanger 50 is shaped like a ring, having a connecting rod 51 raised from the periphery and detachably fastened to the second cap 40. The swivel hook 60 has a spherical coupling end 61 detachably coupled to the first cap 30.

Referring to FIG. 2 again, the rod member 10 further comprises two raised portions 15 raised from the inside wall of the second end 12 at two opposite locations, and a plurality of through holes 16 spaced around the second outward flange 14; the second cap 40 has a tubular coupling portion 41 inserted into the second end 12 of the rod member 10 and forced into engagement with the raised portions 15, and an upright stop rod 42 inserted through the skin 21 of the toy doll 20 and fitted into one of the through holes 16 of the second outward flange 14 of the rod member 10 to prevent rotary motion of the second cap 40 relative to the rod member 10. The connecting structure between the first cap 30 and the first end 11 of the rod member 10 is similar to that between the second cap 40 and the second end 12 of the rod member 10.

Figure 4:
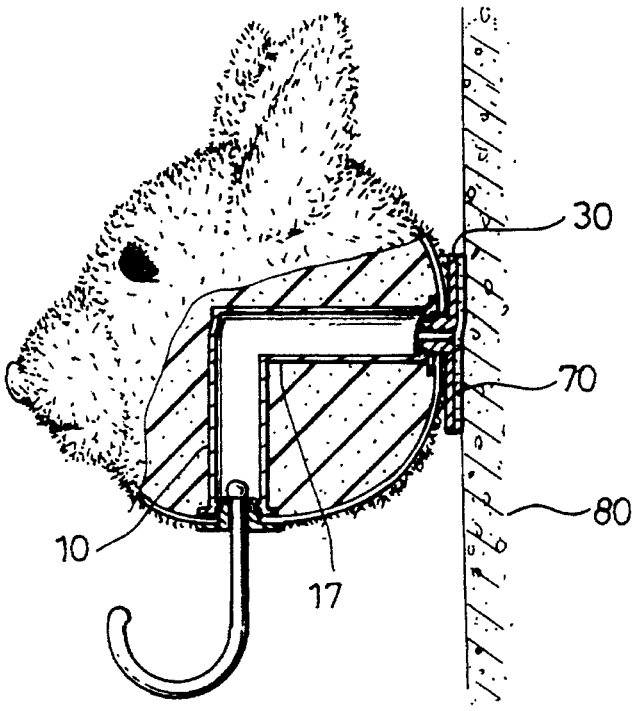
FIG. 4 is an installed view of a toy doll and hanger assembly according to a second embodiment of the present invention.

FIG. 4 shows a toy doll and hanger assembly according to a second embodiment of the present invention, in which the rod member 10 has a right angle portion 17; the first cap 30 is fastened to the wall 80 by a double-sided adhesive tape 70. This alternate form eliminates the installation of the aforesaid swivel hook 60.

Figure 5:
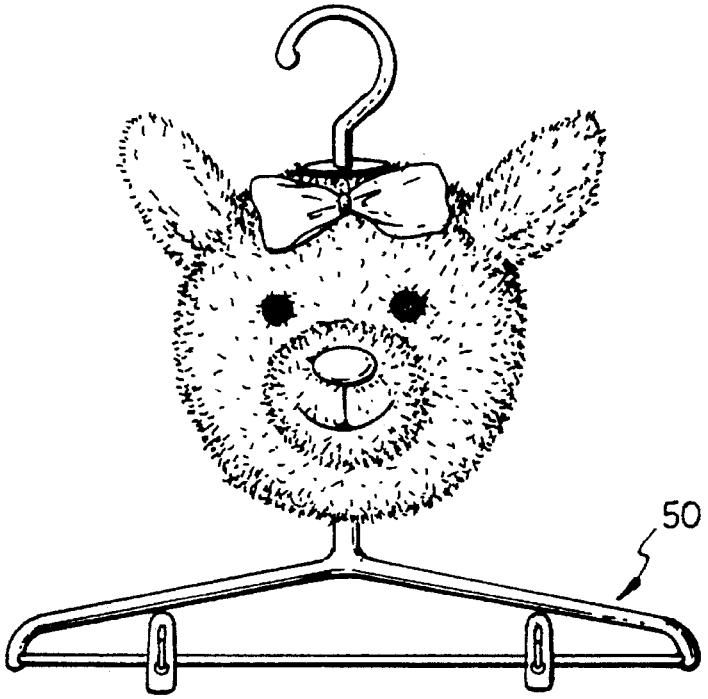
FIG. 5 is an elevational view of a toy doll and hanger assembly according to a third embodiment of the present invention.

FIG. 5 shows a toy doll and hanger assembly according to a third embodiment of the present invention, in which the hanger 50 is a suit hanger.

Figure 6:
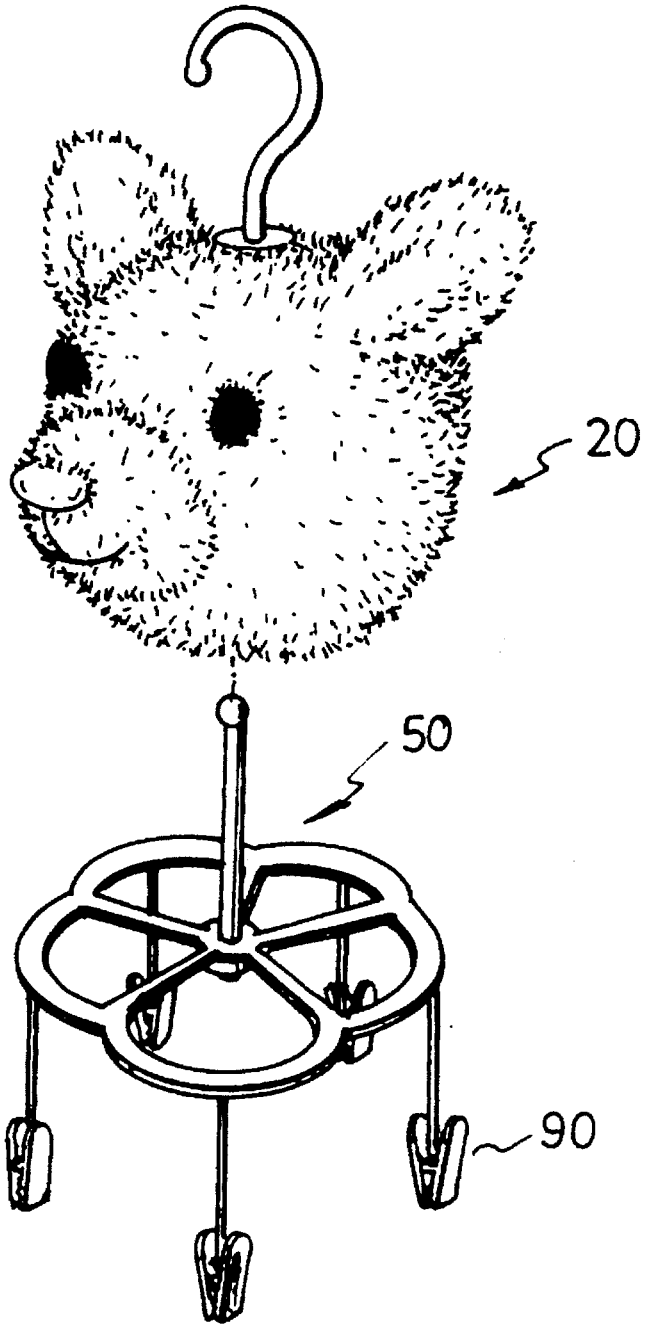
FIG. 6 shows a toy doll and hanger assembly according to a fourth embodiment of the present invention.

FIG. 6 shows a toy doll and hanger assembly according to a fourth embodiment of the present invention, in which the hanger 50 is shaped like a plum blossom having a plurality of clothes clips 90.

Figure 7:
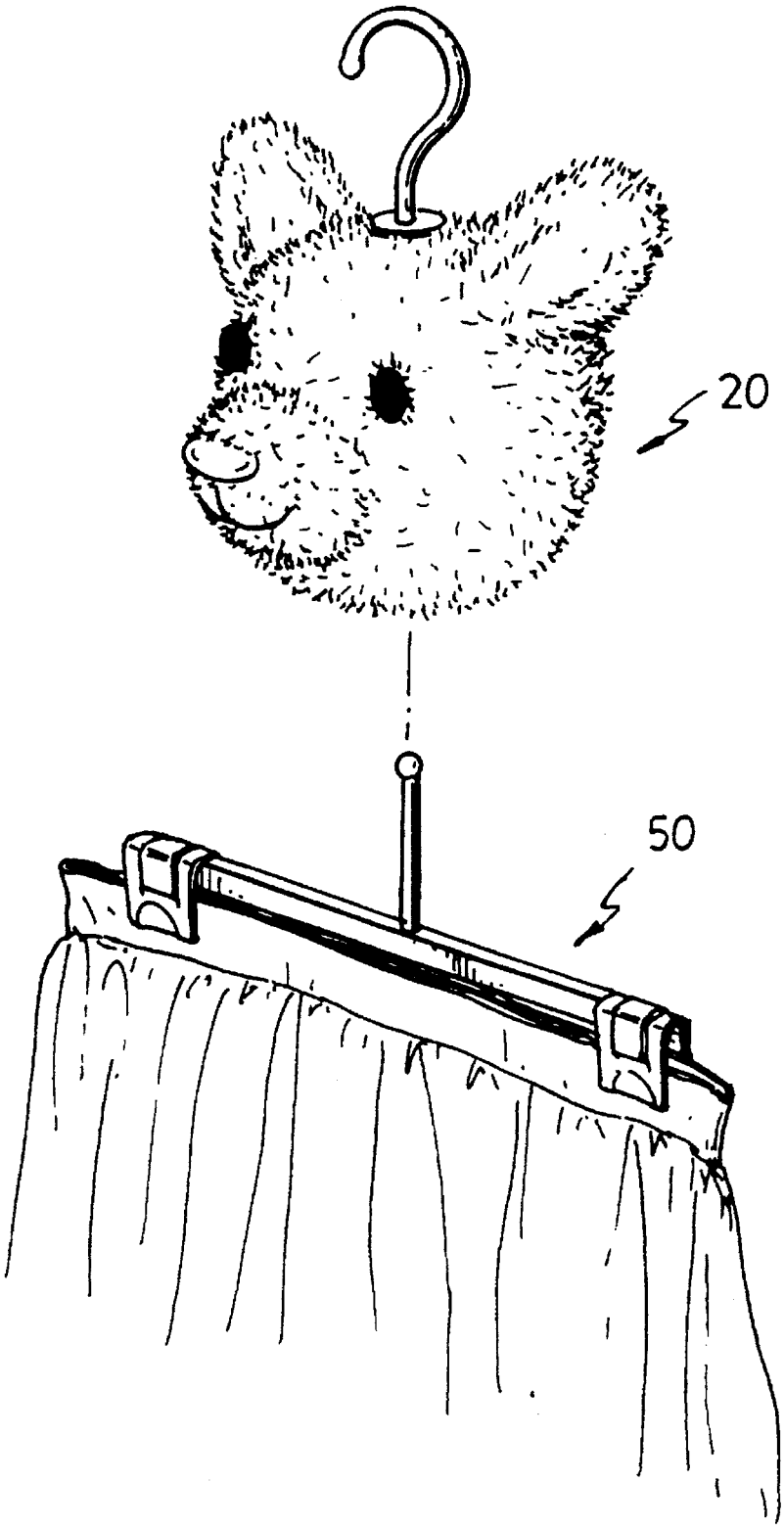
FIG. 7 shows a toy doll and hanger assembly according to a fifth embodiment of the present invention.

FIG. 7 shows a toy doll and hanger assembly according to a fifth embodiment of the present invention, in which the hanger 50 is a device for holding a skirt.

Figure 8:
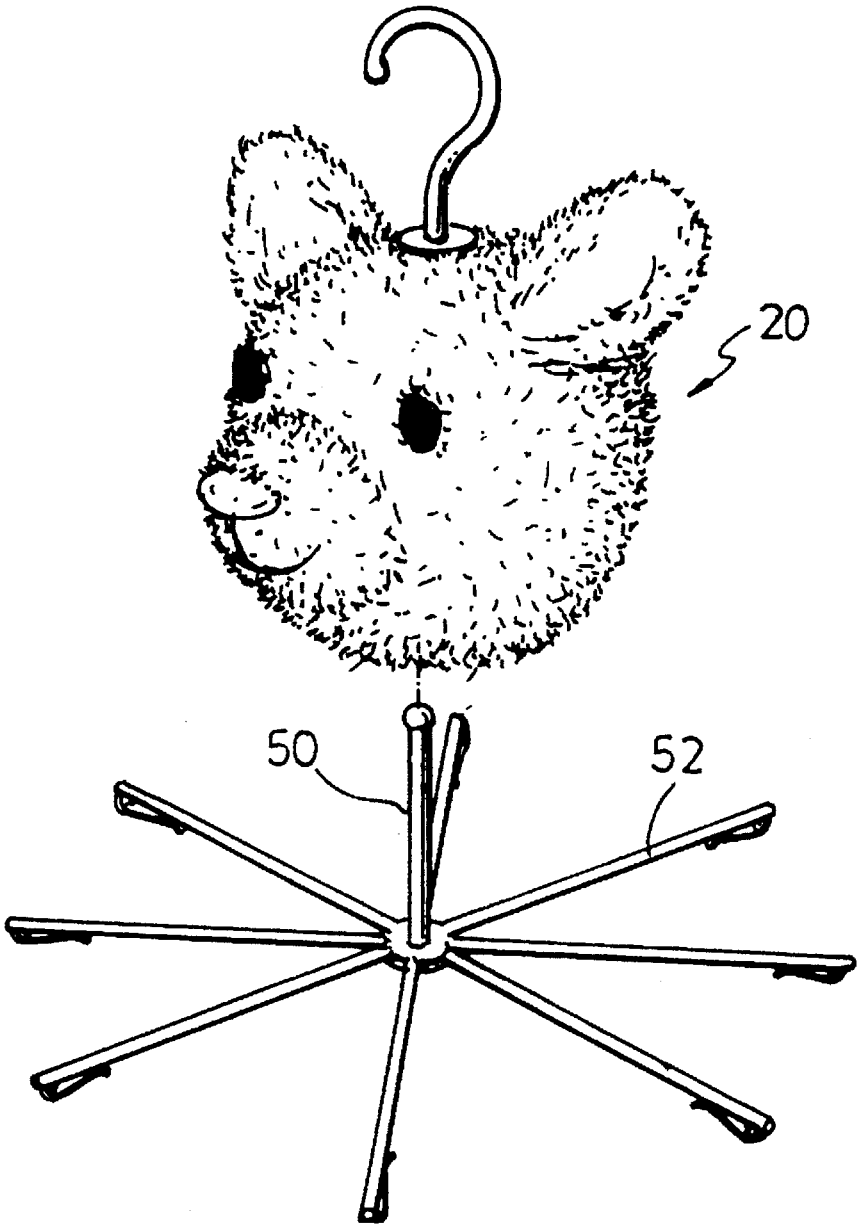
FIG. 8 shows a toy doll and hanger assembly according to a sixth embodiment of the present invention.

FIG. 8 shows a toy doll and hanger assembly according to a sixth embodiment of the present invention, in which the hanger 50 has a plurality of radial branches 52 for hanging clothes.

Figure 9:
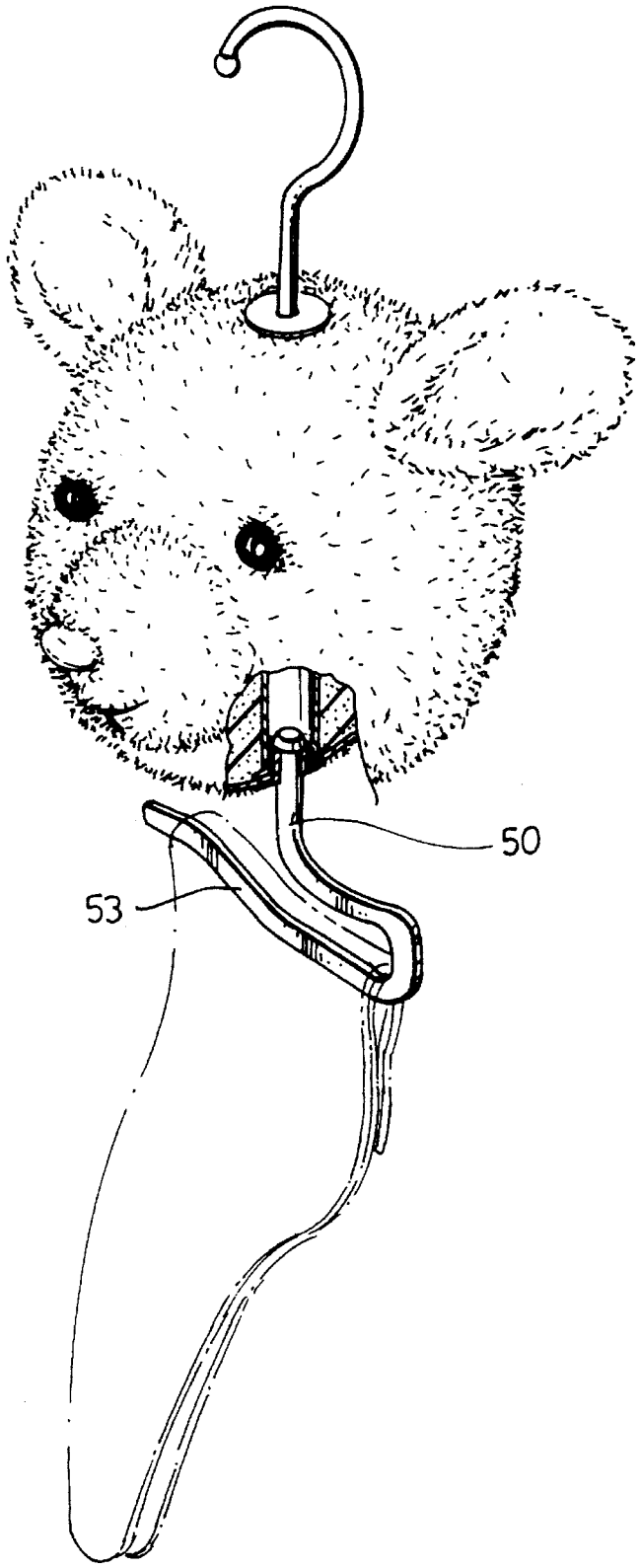
FIG. 9 shows a toy doll and hanger assembly according to a seventh embodiment of the present invention.

FIG. 9 shows a toy doll and hanger assembly according to a seventh embodiment of the present invention, in which the hanger 50 has a bottom end terminating in a transverse hanger rod 53 for hanging clothes.

Figure 10:
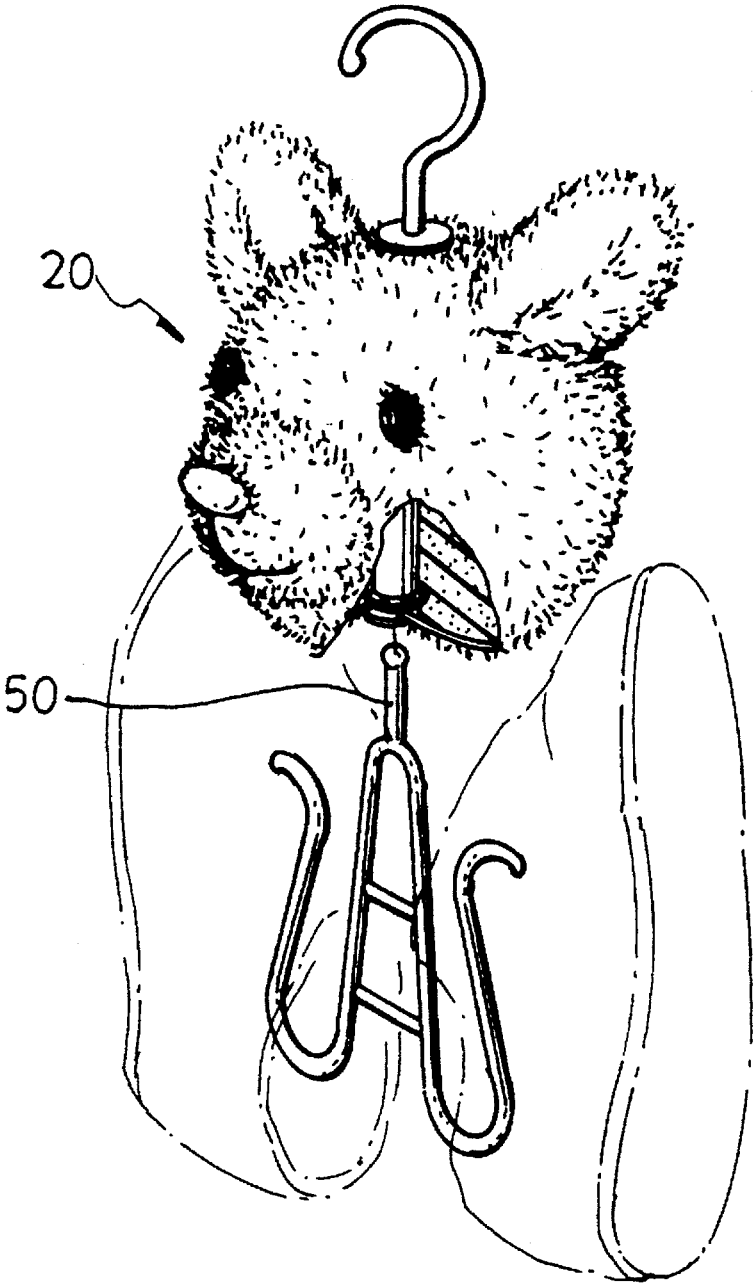
FIG. 10 shows a toy doll and hanger assembly according to an eighth embodiment of the present invention.

FIG. 10 shows a toy doll and hanger assembly according to an eighth embodiment of the present invention, in which the hanger 50 is a double-hook hanger for hanging shoes.

It is to be understood that the drawings are designed for purposes of illustration only, and are not intended as a definition of the limits and scope of the invention disclosed.

What the invention claimed is:

1. A toy doll and hanger assembly comprising:

a rod member having a first end, a second end, a first outward flange raised around said first end, and a second outward flange raised around said second end;

a toy doll covered on said rod member, having a skin, a first hole and a second hole through said skin corresponding to the first end and second end of said rod member;

a first cap fastened to the first end of said rod member and the first hole of said toy doll to hold down the periphery of the first hole of said toy doll, permitting the periphery of the first hole of said toy doll to be retained between said first cap and the first outward flange of said rod member;

a second cap fastened to the second end of said rod member and the second hole of said toy doll to hold down the periphery of the second hole of said toy doll, permitting the periphery of the second hole of said toy doll to be retained between said second cap and the second outward flange of said rod member; and hanger means detachably connected to said second cap.

2. The toy doll and hanger assembly of claim 1 wherein said rod member is a hollow tube having a plurality of raised portion inside said first end and said second end; each of said first cap and said second cap has a tubular coupling portion respectively fitted into the first end and second end of said rod member and forced into engagement with said raised portions.

3. The toy doll and hanger assembly of claim 2 wherein each of the first outward flange and second outward flange of said rod member has at least one through hole; each of said first cap and said second cap has at least one upright stop rod respectively fitted into the at least one through hole of said first outward flange and the at least one through hole of said second outward flange.

4. The toy doll and hanger assembly of claim 2 wherein said rod member has a right angle; said first cap is fastened to the flat surface of a support by a fastening means.

5. The toy doll and hanger assembly of claim 1 wherein said hanger means is a hanger ring having a flanged connecting rod raised from the periphery and connected to said second cap.

6. The toy doll and hanger assembly of claim 1 wherein said hanger means is a hook having a flanged coupling end connected to said second cap.

7. The toy doll and hanger assembly of claim 1 wherein said hanger means is a suit hanger.

8. The toy doll and hanger assembly of claim 1 wherein said hanger means is shaped like a plum blossom having a plurality of clothes clips.

9. The toy doll and hanger assembly of claim 1 wherein said hanger means is a skirt hanger.

10. The toy doll and hanger assembly of claim 1 wherein said hanger means has a plurality of radial branches for hanging things.

11. The toy doll and hanger assembly of claim 1 wherein said hanger means has a bottom end terminating in a transverse hanger rod for hanging things.

12. The toy doll and hanger assembly of claim 1 wherein said hanger means is a double-hook hanger for hanging shoes.

13. The toy doll and hanger assembly of claim 1 further comprising a swivel hook connected to said first cap.

* * * * *